US005402618A

United States Patent [19]

Biffis et al.

[11] Patent Number: 5,402,618

[45] Date of Patent: Apr. 4, 1995

[54] SYSTEM FOR USE IN FABRICATING, TRANSPORTING AND PLACING A PREFABRICATED BUILDING UNIT AT ITS PLACEMENT SITE

[75] Inventors: Lou G. Biffis; Peter R. Biffis; Dino R. Biffis; Rocco A. Lombardi, all of Alliston, Canada

[73] Assignee: Cable Bridge Enterprises Limited, Ontario, Canada

[21] Appl. No.: 815,155

[22] Filed: Dec. 31, 1991

[51] Int. Cl.[6] ..... E04H 1/00

[52] U.S. Cl. ..... 52/745.02; 52/653.1; 52/291; 296/35.3

[58] Field of Search ..... 52/745.02, 291, 745.13, 52/122.1, 653.1, 745.2, 79.1; 296/135.3; 29/791, 793, 794

[56] References Cited

U.S. PATENT DOCUMENTS

| | | | |
|---|---|---|---|
| 1,784,975 | 12/1930 | Rosman | 296/35.3 |
| 2,675,895 | 4/1954 | Loewenstein | 52/653.1 |
| 2,856,644 | 10/1958 | Dunham | 52/291 |
| 3,362,117 | 1/1968 | Van Raden | 52/291 |
| 3,800,493 | 4/1974 | Livingston . | |
| 3,805,365 | 4/1974 | Ashby . | |
| 3,820,216 | 6/1974 | van der Lely et al. . | |
| 3,834,110 | 9/1974 | Vercelletto | 52/745.02 |
| 3,962,773 | 6/1976 | van der Lely . | |
| 3,994,060 | 11/1976 | van der Lely et al. . | |
| 4,110,952 | 9/1978 | Blachura | 52/745.02 |
| 4,421,242 | 12/1983 | Brueske | 52/749 |
| 4,450,617 | 5/1984 | Dillon . | |
| 4,501,098 | 2/1985 | Gregory . | |
| 4,512,120 | 4/1985 | Lindal . | |
| 4,894,909 | 1/1990 | Sakamoto et al. | 29/824 |

FOREIGN PATENT DOCUMENTS

| | | | |
|---|---|---|---|
| 3122334 | 5/1991 | Japan | 52/745.02 |

*Primary Examiner*—Carl D. Friedman
*Assistant Examiner*—Wynn E. Wood
*Attorney, Agent, or Firm*—Smart & Biggar

[57] ABSTRACT

There is described a method and system for fabricating, transporting and placing building units at a site. A production line is located at the site for fabrication of the building units, each unit is transported from the assembly line to a preselected foundation, and the unit is placed on the foundation. Each unit is fabricated on a flatbed and slid onto a flatbed truck. Each unit is constructed on a base member to which a lifting device is attachable to transpose the unit from the truck to the foundation.

8 Claims, 7 Drawing Sheets

SYSTEM FOR USE IN FABRICATING, TRANSPORTING AND PLACING A PREFABRICATED BUILDING UNIT AT ITS PLACEMENT SITE

BACKGROUND OF THE INVENTION

It is well known to fabricate a building under mass production assembly line conditions, thereafter to transport the prefabricated building unit to its building site and to lift the prefabricating building unit into place on a prepared foundation at the site.

Examples of assembly line techniques for prefabricating building units such as house structure are to be seen in U.S. Pat. Nos. 3,805,365, 3,820,216 and 3,994,060.

Specialized units for transporting the building unit through the assembly line during fabrication are to be seen, for example, in U.S. Pat. Nos. 3,962,773 and 4,450,617.

An example of transporting modular home sections from the fabricating assembly line to the placement site, by means of flatbed trucks, is to be seen in U.S. Pat. No. 4,512,120.

Finally, lifting devices for use with cranes to lift the prefabricated unit and place it in its final place are to be seen, for example in U.S. Pat. Nos. 3,800,493 and 4,501,098.

Such systems suffer from the disadvantage that the assembly line is located remote from the building site. These previous arrangements have also suffered drawbacks in that the building unit during fabrication has required a great deal of handling on the assembly line and the systems for moving the units being fabricated though the assembly line have been complex, or suffered from handling drawbacks when moving the prefabricated structure on to a truck to transport it to the building site. Also the devices for lifting the prefabricated building units into position have been complex and somewhat difficult to use.

SUMMARY OF THE INVENTION

The present invention seeks to mitigate the drawbacks of the prior art by providing a method and system for use in fabricating, transporting and placing the building units on foundations, all being effected on site.

According to the present invention there is provided a system of fabricating, transporting and a base member upon which the building unit is erected. The base member of the system comprises a rectangular metal frame, at least two opposing sides of which are L-section, inwardly directed to provide, on the opposing sides, a marginal shelf and a marginal outer wall upstanding from the marginal shelf aligned cross-beam receiving brackets inwardly directed from the opposing sides, cross beam members received in the brackets and secured to the frame; and building unit lifting lugs attached to, and projecting outwardly from, the rectangular frame.

According to a preferred feature of the base member, tensioned members extend parallel to the cross-beam members and are detachably attached to the opposing sides of the frame. The tensioned members are preferably provided with turnbuckles to control the tension in the members.

According to one preferred feature of the base member spacer members are positioned along the marginal shelves within the marginal outer walls and carry the cross-beam receiving brackets.

Preferably the device of the system for transporting the base member during fabrication of the building unit comprises a flatbed for supporting the base member; rail engaging wheels beneath the flatbed, and an anti-friction surface on the flatbed (such as a roller conveyor) to permit the fabricated building unit to be slid off the flatbed after completion of fabrication.

According to yet a further preferred feature, the means to transport the prefabricated building unit to its site comprises a flatbed truck provided with an anti-friction surface and dimensioned to receive the prefabricated building unit when slid off the transporting device.

According to still a further feature of the invention, a prefabricated building unit lifting frame is provided for attachment to the base member and preferably the lifting frame comprises a rectangular structure, crane hook attaching elements on the structure, and a plurality of building unit lifting cord, straps, or like members on the structure, the cord or like members having lifting lug engaging attachments. According to one preferred feature of the invention the lifting cords or like members may be of unitary configuration.

According to another aspect of the invention there is provided a system of fabricating, transporting, and placing a building unit at a site, comprising: at least one production line for fabricating a building unit having an input end and an output end and including a transport device having a flatbed, said transport device being movable from the input end to the output end of the production line through a series of workstations, said building unit being fabricated on an upper surface of said flatbed, said flatbed having an anti-friction surface on the upper surface thereof for permitting sliding movement of said building unit relative to said transport device; a first transport means to transport said building unit from the output end of said production line to a preselected foundation, said transport means having a flatbed with an anti-friction surface on the upper surface thereof for permitting sliding movement of said building unit thereon; a means to slide the building unit from the flatbed of said transport device when said transport device is at the output end of said production line to the flatbed of said transport means; a second transport means to transfer the transported building unit from the flatbed of said transport means to said preselected foundation of said site.

According to another aspect of the invention there is provided a system for fabricating and transporting building units to a plurality of building sites, comprising (a) a factory site having at least one production line for fabricating a building unit, said production line having an input end and an output end; (b) a road array comprising an outer ring road, a first inner ring road located inside said outer ring road, a second inner ring road located inside said outer ring road, positioned remote from said first inner ring road, a first connecting road linking said outer ring road and said first inner ring road, a second connecting road linking said outer ring road and said second inner ring road, at least one factory site connecting road linking said factory site to said outer ring road; (c) a plurality of building sites located adjacent said inner and outer ring roads; (d) means to transport a building unit fabricated on the at least one production line along the road array; said factory site being disposed inside said outer ring road and between said first and second inner ring roads.

DESCRIPTION OF THE DRAWINGS

The following is a description by way of example of one preferred embodiment of the invention reference being had to the accompanying drawings in which.

DESCRIPTION OF PREFERRED EMBODIMENT

Figure 1:
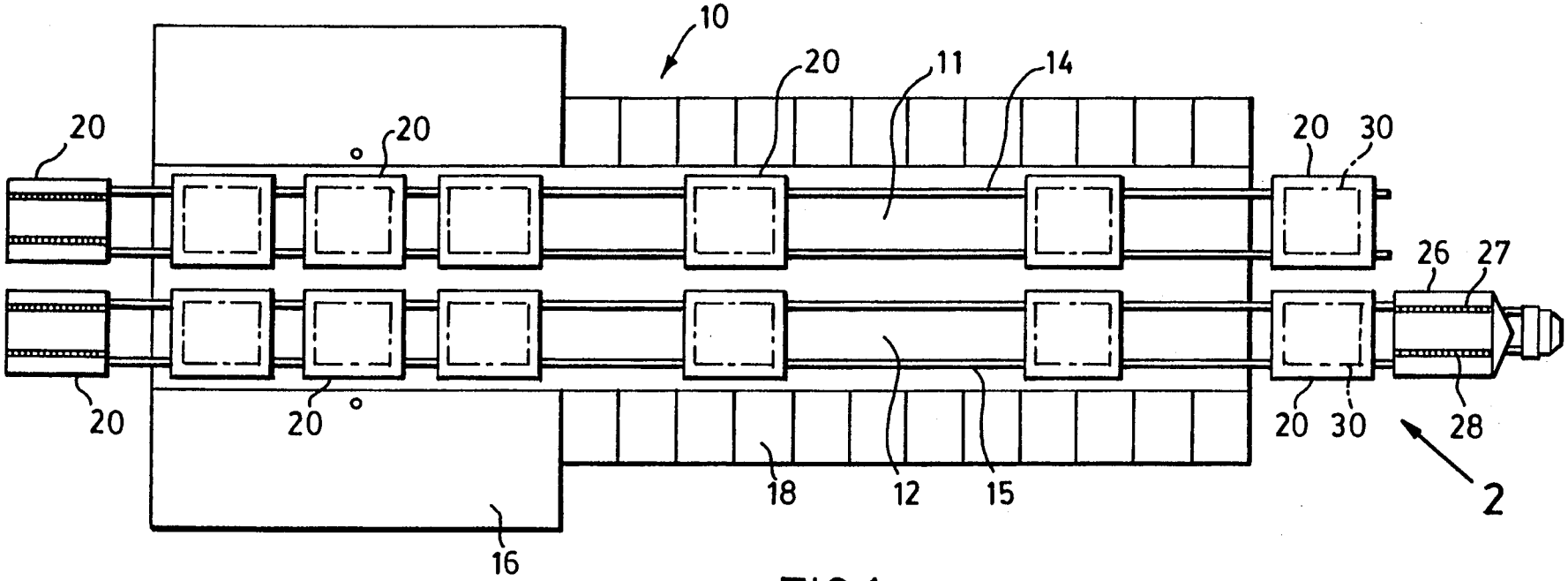
FIG. 1 is plan view of an assembly line for assembling prefabricated building units.
Figure 2:
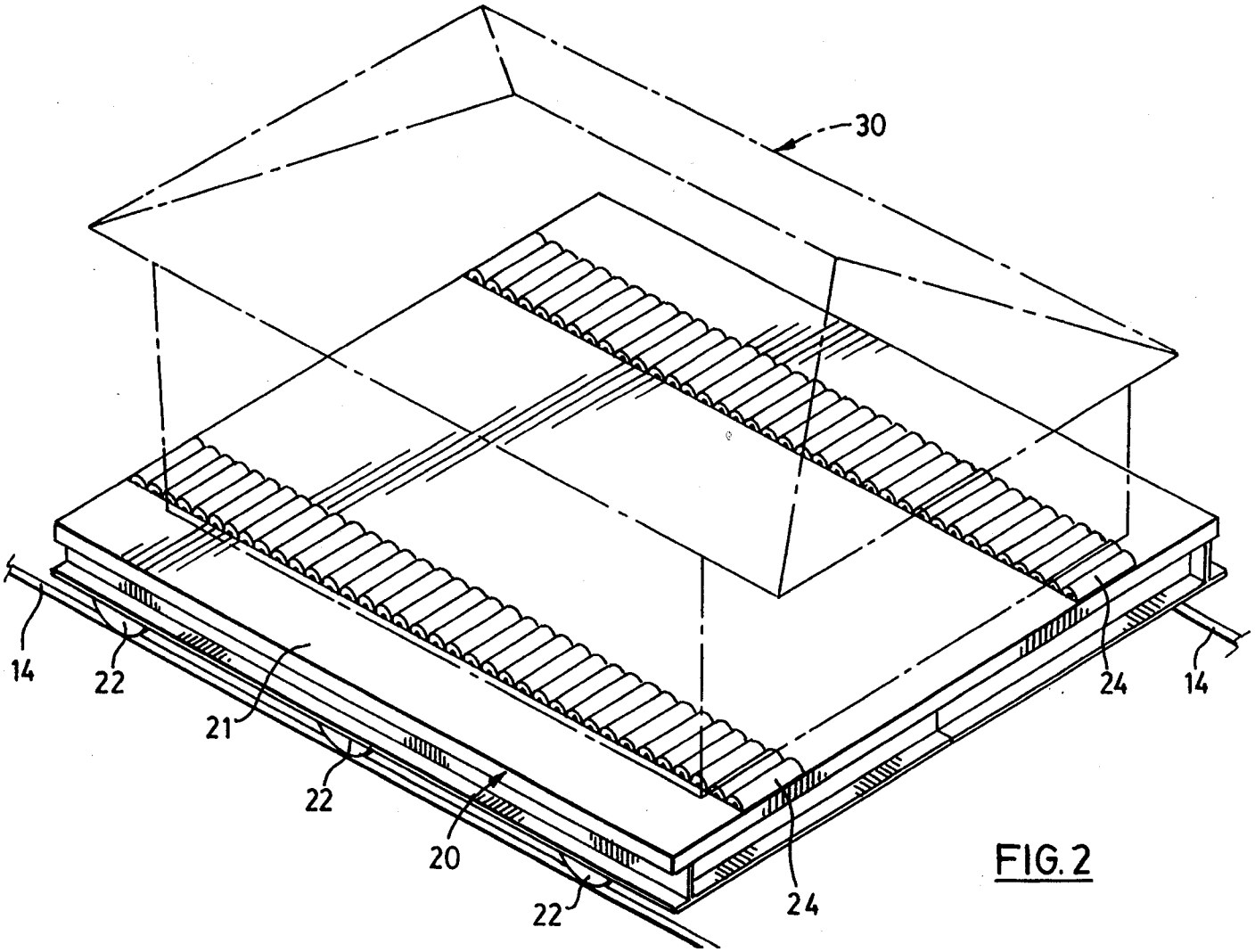
FIG. 2 is a perspective sketch of the transportation device which carries the building unit through the assembly line during its fabrication.

Turning now to the drawings. In FIGS. 1 and 2 a fabricating production line 10 is a factory-like facility in which two parallel production lines, 11 and 12, are placed side by side. The production lines each include its own railway track 14, 15 extending through the assembly facility past a basic construction area 16 and then past a plurality of bays 18 providing storage space for light construction and finishing materials such as window frames and doors, plumbing and electrical supplies. Basic construction area 16 and bays 18 are collectively referred to as "work stations". Running on the tracks 14 and 15 are a plurality of transporting devices 20 each comprising a flatbed 21 (see FIG. 2) having a series of railway track engaging wheels 22 therebeneath and anti-friction surfaces, such as roller conveyors 24, on the upper surfaces of the flatbed.

As the devices 20 proceed from left to right as seen in FIG. 1, the building unit 30 is erected on the base member of the system, which base member will be described in more detail hereinafter with reference to FIGS. 4, 5 and 6. Fabrication of the building unit 30 continues throughout the production line until finally it is rolled out to a loading bay 25 on the right hand side of FIG. 1. Here a means to transport the prefabricating building unit to the building site is provided in the form of a flatbed truck 26 which is dimensioned so that the building unit 30 can be slid off the roller conveyors 24 on the flatbed 21, onto the flatbed 27 of the truck 26 which itself has an anti-friction surface on top of its flatbed, which anti-friction surface may be a roller conveyor 28 similar to the roller conveyor 24.

Figure 3:
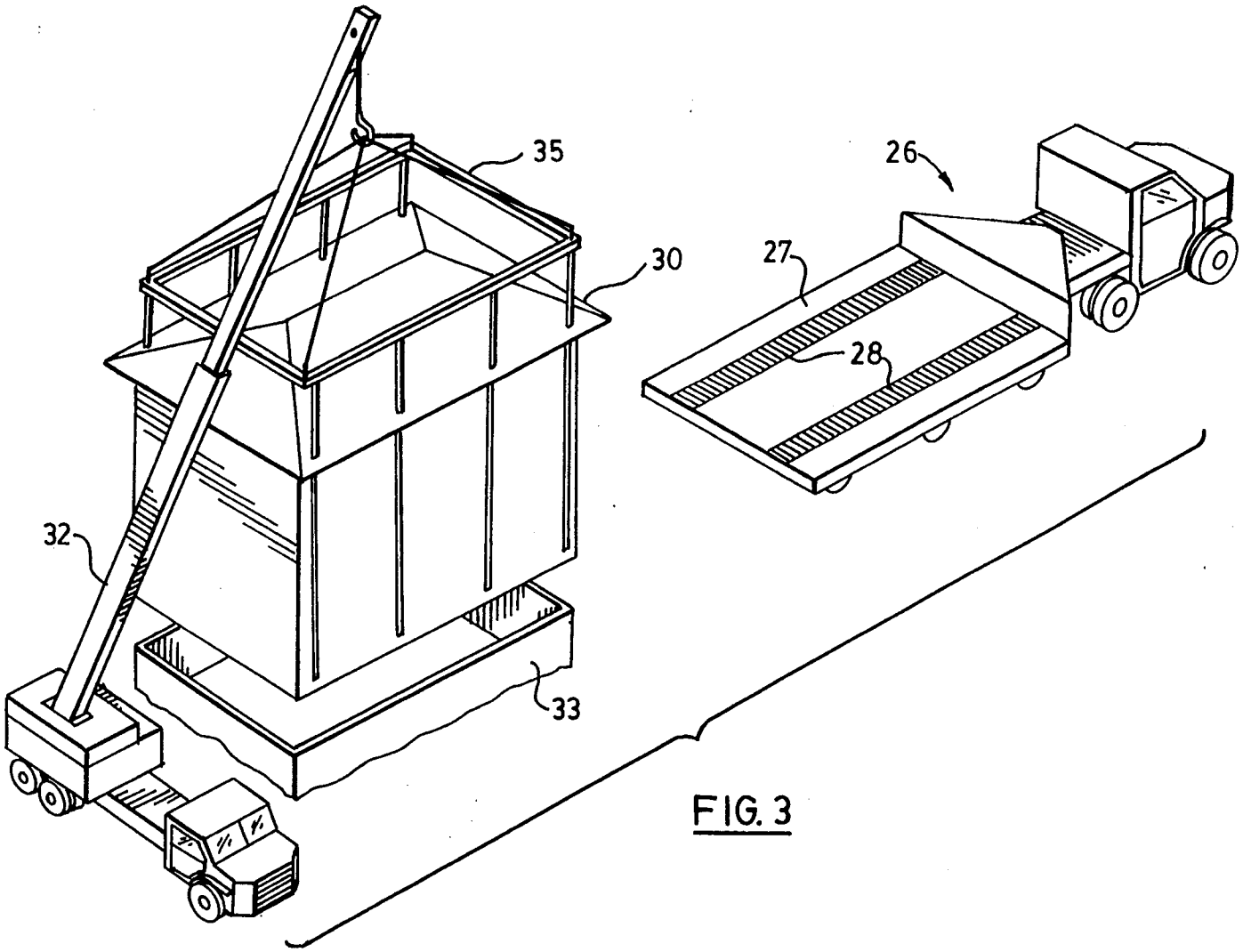
FIG. 3 is a perspective sketch of the device for transporting the prefabricated structure to the building site and the means for lifting the prefabricated unit into place on its foundations.

The prefabricated unit 30 is then conveyed to the building site by the truck 26 where it is lifted into position by means of a crane 32 (see FIG. 3) onto the building foundation 33. In order to provide a means by which the crane 32 can lift the unit 30 and set it into place, the system of the present invention provides a lifting frame 35 (see also FIG. 4). The lifting frame 35 is a rectangular structure 36 provided at its corners with crane hook attaching elements, such as eye bolts 37 which receive crane cables 34. Attached to, and depending from opposite sides of the rectangular structure 36 are a series of building unit lifting cord members 39. Lifting cord members 39 may be of any suitable configuration such as cables, or straps, or the like and the cord members terminate in lifting attachments 40 which will be described more fully hereinafter. The lifting cord members 39 are shown in FIG. 4 as of unitary configuration, that is to say they are a single unit from their point of attachment to the rectangular structure 36 to the attachment elements 40, passing through prefabricated slots 41 in the roof 42 of the building unit 30. However, it is to be understood that in some forms of construction it may be desirable to split the cords above their slots 41 such as at point 45 in FIG. 4, the upper part of the cord **39*a* being disconnectably connected at the point 45 to the lower end of the cord 39*b*. By having the cords 39 detachably attached in this fashion it is possible to leave the lower part of the cord 39*b* in place after the building unit 30** has been arranged on its placement site.

Figure 4:
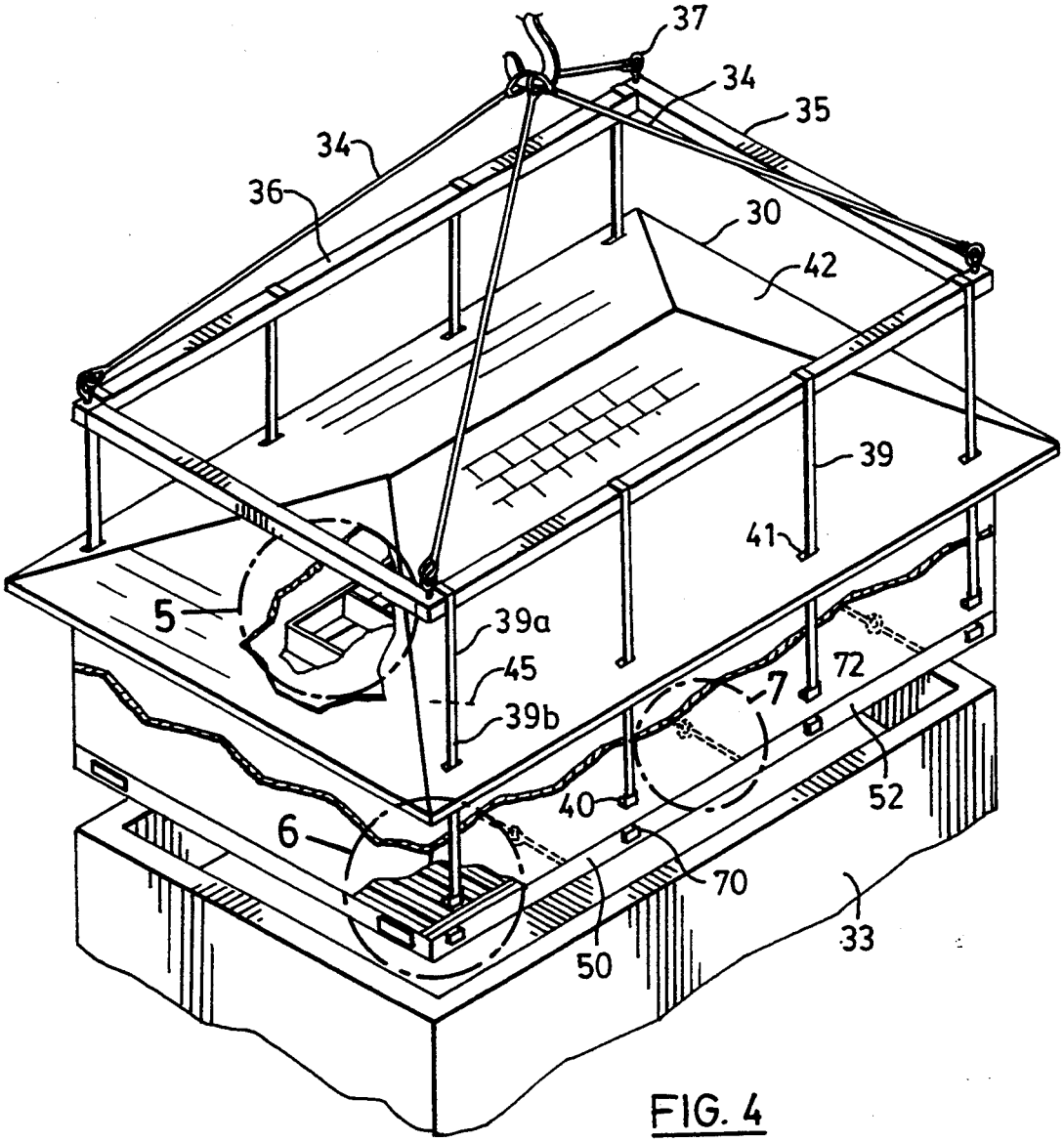
FIG. 4 is a detail, to an enlarged scale, of the system shown in FIG. 3.
Figure 5:
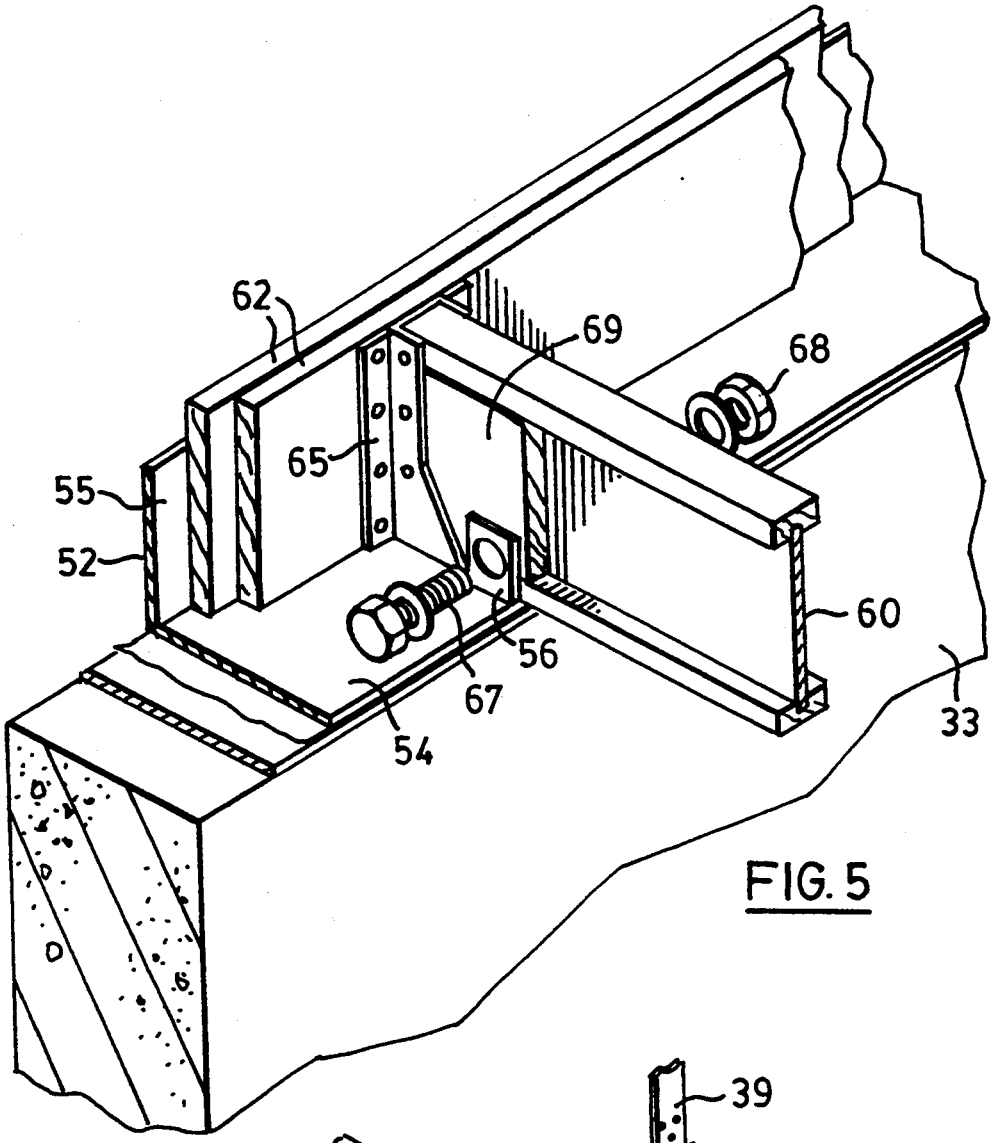
FIGS. 5, 6, and 7 are details, to an enlarged scale, of the items circled and numbered 5, 6, and 7, in FIG. 4.
Figure 6:
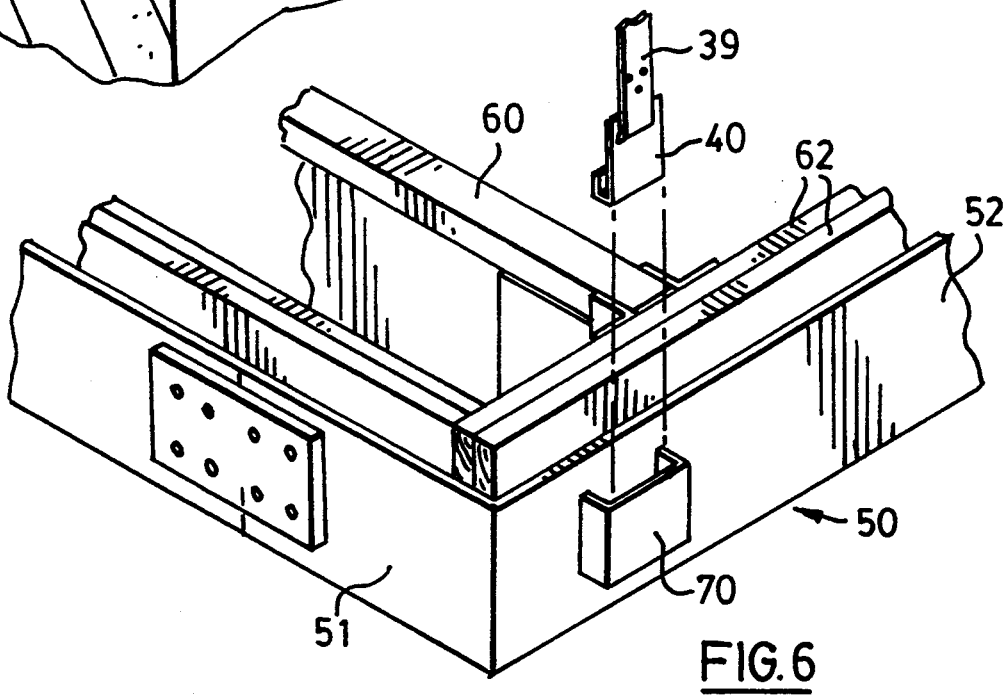
Figure 7:
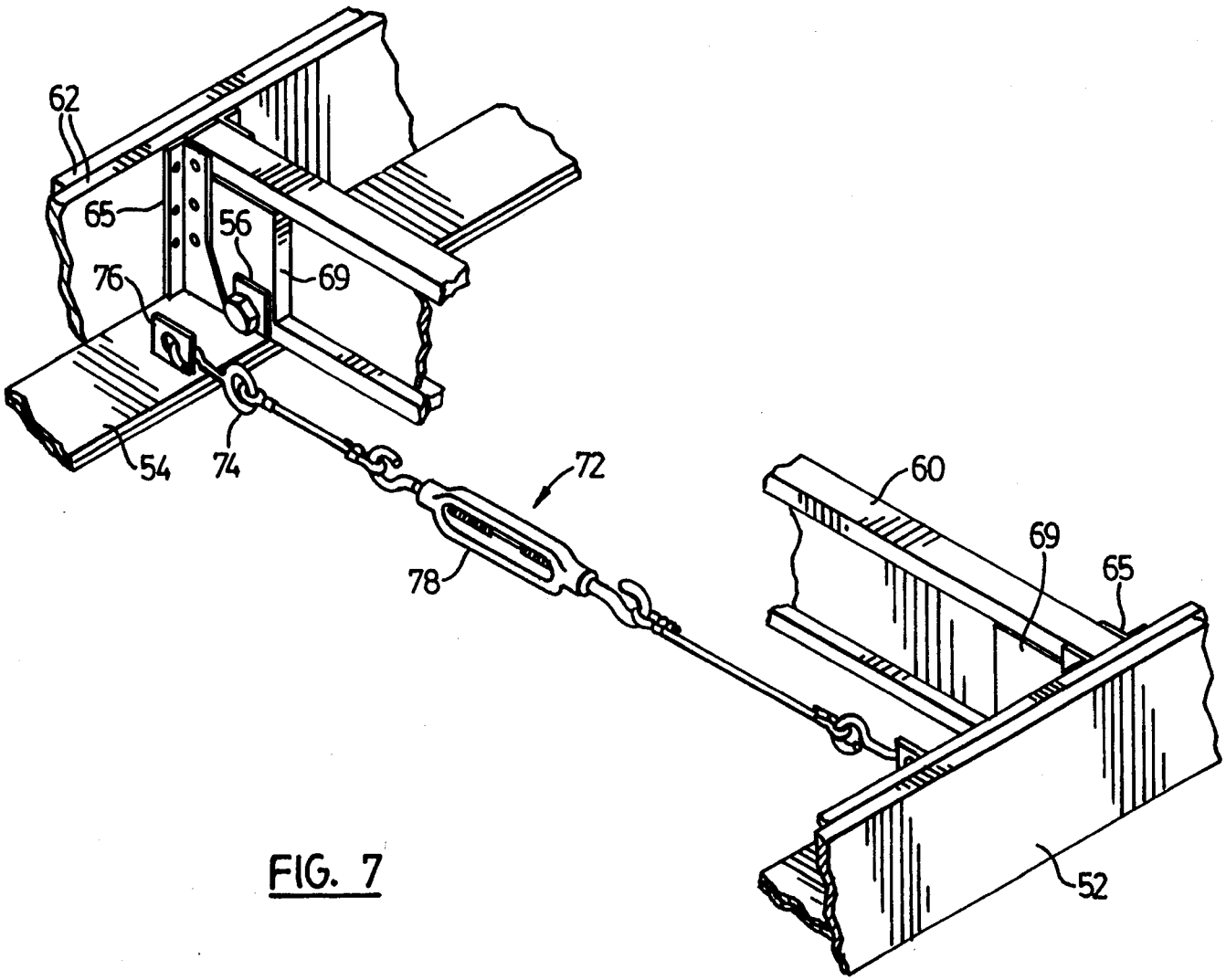

Turning now to FIGS. 4, 5 and 6, these Figures show in more detail the base member 50 which provides the uniting feature of the system and on which the building unit 30 is assembled. The base member 50 comprises a rectangular steel frame 51 at least two opposing sides 52 of which are of inwardly directed L-section to provide on opposite sides a marginal shelf 54 and a marginal outer wall 55 upstanding from the shelf. Preferably all four sides of the rectangular frame are of similar inwardly directed L-section. Lugs 56, only one of which is shown in FIG. 5, upstand from the shelves 54 to receive a cross-beam 60, preferably of I-section wood. Spacer members, seen here as two plank-like wooden elements 62, rest on the shelves 54 at opposite sides of the rectangular metal frame inside the marginal outer walls 55 and carry aligned cross-member receiving brackets 65. The cross-members 60 are positioned firmly in the brackets 65 and span the rectangular steel frame 51, as seen in FIGS. 5, 6 and 7. The ends of the cross-beams 60 are received in the receiving brackets 65 and a bolt 67 is passed through the lugs 56 and through holes in a pair of filler blocks 69 located one on each side of the I-beam 60. A nut 68 engages the bolt 67 and is tightened to clamp the cross-beam 60 to the frame 51 in the brackets 65.

It will be understood that in FIG. 5 although the frame 50 appears to be in place on the foundation with the bolt 67 and nut 68 disconnected, this is for the purposes of illustration only. Obviously the cross-beams 60 will be well secured as an early step in fabrication of the base member 50 and before the rest of the building unit 30 is assembled on the base member 50.

Building unit lifting lugs 70 are provided on the opposite sides of the rectangular metal frame 51. These lugs receive lifting lug attachment elements 40 at the ends of the straps 39.

It will be noted that when the elements 40 are hooked onto the lugs 70 the entire building unit can be lifted on its own base frame 50.

In order to decrease any tendency for the rectangular frame 51 of the base member 50 to be warped during assembly and transportation of the building unit, a plurality of tensioned members 72 (see FIGS. 4 and 7) are detachably attached by suitable means such as hooks 74 to eyes 76 fixed to the opposing sides of the frame. The members 72 extend parallel to the cross-beams 60 and are preferably provided with turnbuckles 78, or the like, whereby the tension in the member 72 can be controlled. When the building unit 30 has been arranged on its placement site and bolted to its foundation 33, the turnbuckles 72 can be slackened and the members 70 removed for reuse.

It will be understood that although the lugs 70 have been shown of U-shape with the attachment elements 40 of hook configuration, different shapes of lug and hook could be provided to accommodate different situations.

Thus the base member 50 provides a jig upon which the fabrication of the unit 30 takes place, provides for cooperation with the transporting device 20 for ease of movement through the assembly line and transfer onto the flatbed truck 26, and provides the means whereby the lifting frame 35 can lift the building unit 30 from the truck and deposit it on its foundation 33, thereby achieving a smooth unitary flow from fabrication through transportation, to final placement.

Figure 8:
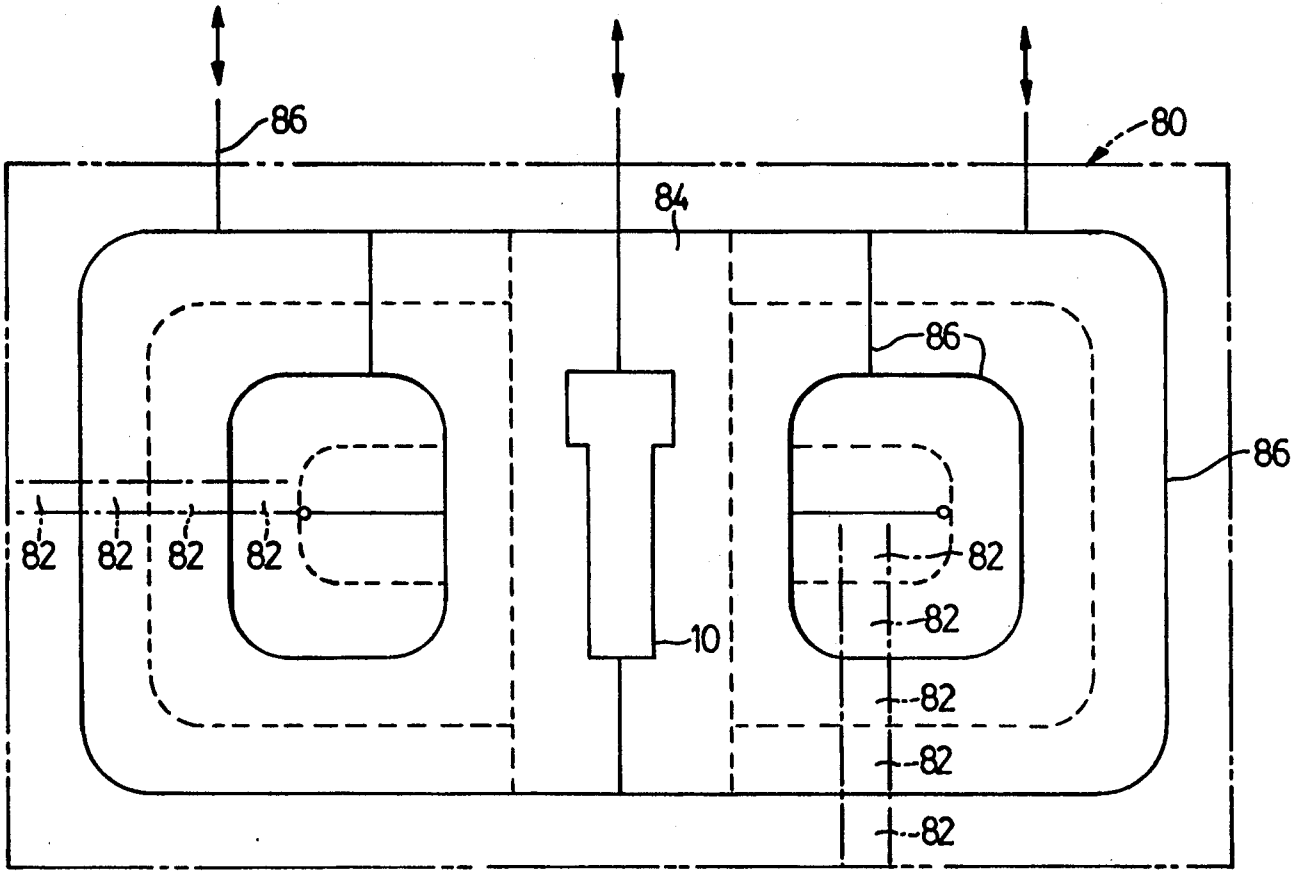
FIG. 8 is a schematic view of a subdivision building plan.

The plan of FIG. 8 shows a land subdivision or site 80 parcelled into individual building lots 82 and including a parkland area 84. Prefabricated units 30 are located each on a lot 82 which has a foundation 33. Production line 10 is erected on parkland area 84 and the service roads 86 of subdivision 80 are used to transport each building unit 30 from the production line to a preselected lot 82 and foundation 33.

The road array constituted by service roads 86 includes an outer ring road **86*a* and two inner ring roads 86*b*, 86*c*. Inner ring roads 86*b* and 86*c* are linked to outer ring road 86*a* by first and second connecting roads 86*d* and 86*e* respectively. Production line 10, having an input end 10*a* and an output end 10*b*, is located at a factory site located inside outer ring road 86*a* and between inner ring roads 86*b* and 86*c*. The factory site is linked to outer ring road 86*a* proximate input end 10*a* by a first factory site connecting road 86*f*. The factory site is also linked to outer ring road 86*a* proximate output end 10*b* by a second factory site connecting road 86*g*. Factory site connecting roads 86*f* and 86*g* both take the shortest distance possible to link to outer ring road 86*a*. Located outside of outer ring road 86*a* and linked thereto are a plurality of access roads 86*h*. Interior roads 86*j* and 86*k* are linked to inner ring roads 86*c* and 86*b* respectively and disposed therein. When the placement of building units 30 on lots 82 has been completed, production line 30 may be dismantled and parkland area 84** converted to its true use.

It will be seen from the layout of FIG. 8 that by locating production line 10 on site 80 the time and cost problems associated with transporting the building units 30 to foundations 33 are avoided.

We claim:

1. A system of fabricating, transporting, and placing a building unit at a site, comprising:

at least one production line for fabricating a building unit having an input end and an output end and including a transport device having a flatbed, said transport device being movable from the input end to the output end of the production line through a series of workstations, said building unit being fabricated on an upper surface of said flatbed, said flatbed having an anti-friction surface on the upper surface thereof for permitting sliding movement of said building unit relative to said transport device, a first transport means to transport said building unit from the output end of said production line to a preselected foundation, said first transport means having a flatbed with an anti-friction surface on the upper surface thereof for permitting sliding movement of said building unit thereon;

a means to slide the building unit from the flatbed of said transport device when said transport device is at the output end of said production line to the flatbed of said first transport means;

a second transport means to transfer the transported building unit from the flatbed of said first transport means to said preselected foundation of said site.

2. A system as claimed in claim 1 wherein said transport device has wheels engaging and movable along a track positioned and running from said input end to said output end.

3. A system as claimed in claim 1 wherein said anti-friction surface on the upper surface of the flatbed of said first transport means comprises a plurality of roller conveyors.

4. A system as claimed in claim 3 wherein said anti-friction surface on the upper surface of the flatbed of said transport device comprises a plurality of roller conveyors.

5. A system as claimed in claim 1 wherein said production line is located at a site.

6. A system as claimed in claim 1 wherein said production line may be readily dismantled.

7. A system as claimed in claim 1 comprising a pair off production lines orientated generally parallel to one another.

8. A system as claimed in claim 1 wherein said first transport means comprises a road transport device.

* * * * *

UNITED STATES PATENT AND TRADEMARK OFFICE

CERTIFICATE OF CORRECTION

PATENT NO. : 5,402,618
DATED : April 4, 1995
INVENTOR(S) : Lou G. Biffis, et al.

It is certified that error appears in the above-indentified patent and that said Letters Patent is hereby corrected as shown below:

column 6, line 13, delete "," and insert --;-- column 6, line 44, delete "off" and insert --of--.

Signed and Sealed this

Eleventh Day of July, 1995

*Attest:*

Bruce Lehman

BRUCE LEHMAN

*Attesting Officer*

*Commissioner of Patents and Trademarks*